US010201184B1

(12) United States Patent
Fischer

(10) Patent No.: US 10,201,184 B1
(45) Date of Patent: Feb. 12, 2019

(54) CIGAR CUTTER EMPLOYING MAGNETIC FIELDS

(71) Applicant: Brett William Fischer, Lee's Summit, MO (US)

(72) Inventor: Brett William Fischer, Lee's Summit, MO (US)

( * ) Notice: Subject to any disclaimer, the term of this patent is extended or adjusted under 35 U.S.C. 154(b) by 0 days.

(21) Appl. No.: 15/719,589

(22) Filed: Sep. 29, 2017

(51) Int. Cl.
*A24F 13/24* (2006.01)

(52) U.S. Cl.
CPC ..... *A24F 13/24* (2013.01)

(58) Field of Classification Search
CPC ..... A24F 13/24; A24F 13/26; A24F 13/20
USPC ..... 30/109
See application file for complete search history.

(56) References Cited

U.S. PATENT DOCUMENTS 519,332 A * 5/1894 Hopkins ..... A24F 13/26 30/113
1,058,999 A * 4/1913 Patten ..... A24F 13/26 15/104.012
1,061,236 A * 5/1913 Fuller ..... A24F 13/26 30/113
1,082,257 A * 12/1913 Astruck ..... A24F 13/26 30/113
1,119,220 A * 12/1914 Bates ..... A24F 13/26 30/113
1,177,098 A * 3/1916 Guy ..... A24F 13/26 30/112
5,643,114 A * 7/1997 Marcus ..... A24F 13/22 473/408
5,992,022 A * 11/1999 Carrera Moya ..... A24F 13/24 131/248
6,572,495 B1 * 6/2003 Ferrari ..... A24F 13/24 473/408
7,770,295 B2 * 8/2010 Smith ..... A24F 13/26 131/248
D623,352 S * 9/2010 Melgaard ..... D21/793
D630,794 S * 1/2011 Cohen Harel ..... D27/195
8,656,595 B2 * 2/2014 Wong ..... A24F 13/26 30/109
2006/0249166 A1 * 11/2006 Lauzon ..... A24F 13/20 131/248
2007/0000133 A1 * 1/2007 Kasuli ..... A45F 5/02 30/113
2009/0113719 A1 * 5/2009 Smith ..... A24F 13/26 30/113
2009/0211589 A1 * 8/2009 Smith ..... A24F 13/26 131/328
2010/0175266 A1 * 7/2010 Fischer ..... B26D 3/162 30/92
2011/0302785 A1 * 12/2011 Chuan ..... A24F 13/26 30/113
2013/0180113 A1 * 7/2013 Liao ..... A24F 13/26 30/113
2014/0082945 A1 * 3/2014 Lance ..... A24F 13/24 30/112

(Continued)

*Primary Examiner* — Jason Daniel Prone
*Assistant Examiner* — Richard D Crosby, Jr.

(57) ABSTRACT

A guillotine-style cigar cutter. The cutter includes a body with a central aperture and a pair of blades disposed on opposite sides of the aperture and configured to move translationally across the aperture to cut an end of a cigar in preparation for smoking. Magnets are disposed to each blade to provided movement of the cutter open or closed depending on the orientation of the magnetic poles relative to one another.

18 Claims, 5 Drawing Sheets

(56) References Cited

U.S. PATENT DOCUMENTS

| | | | | |
|---|---|---|---|---|
| 2015/0000140 | A1* | 1/2015 | Lance | A24F 13/26<br>30/112 |
| 2015/0257440 | A1* | 9/2015 | Fischer | A24F 13/24<br>131/255 |
| 2017/0035106 | A1* | 2/2017 | Spurling, III | A24F 13/24 |

* cited by examiner

[ ] = Magnet
N = North Magnetic Pole
S = South Magnetic Pole

CIGAR CUTTER EMPLOYING MAGNETIC FIELDS

CROSS-REFERENCE TO RELATED APPLICATION

Non Applicable

BACKGROUND OF THE INVENTION

Cigars are typically manufactured, either by hand or by machine, with one end that is cut and an opposite end that is closed off to form a cap. The cap must be cut or punctured prior to smoking to allow air and smoke to be drawn through the cap end of the cigar. A variety of devices are known in the art for preparing the cap of the cigar for smoking including punches, V-cutters or notch cutters, knives, scissors, and guillotine cutters.

Exemplary guillotine cutter are described in U.S. Pat. No. 8,656,595 to Wong and U.S. Patent Publication No. 2010/0162596 to Smith. These cutters includes a housing with a central aperture in which a cigar can be inserted. A pair of oppositely oriented guillotine blades are provided that intersect the aperture and are sliceable movable across the aperture to engage and cut through the cigar inserted therein. Each of the blades is biased by a spring to move outwardly away from the aperture to allow insertion of the cigar therein, or the blades can be pressed toward one another and locked in a position lying across the aperture.

U.S. Patent Publication No. 2017/0231271 to Xikar discloses a guillotine like cigar cutter device that employs use of a gear-train cooperating in conjunction with a ring gear and spring to simultaneously and symmetrically move two cutting blades. The blades are locked together using the respective gear-train coupled with a manual depressible trigger. Once unlocked, a spring transfers energy into the gear-train and forces the blades pivotally apart to an open position.

SUMMARY OF THE INVENTION

This invention relates to cigars. More specifically, the present invention relates to a cigar cutter device adapted to incorporate affixed magnets that make it easy to open or close while cutting the end of a fine cigar.

Typically, simple devices for cigar cutting consist of one or two blades slidably mounted in a case, which blade(s) have to be manually opened. Manual opening can be tedious and creates an unnecessary steps for the user to deploy the cigar cutting device. Other cigar cutter devices are over complicated and have excessive moving parts that can wear to render the device useless or ineffective at cutting a cigar tip with desired precision.

BRIEF DESCRIPTION OF THE DRAWINGS

Illustrative embodiments of the invention are described in detail below with reference to the attached drawing figures, and wherein.

DETAILED DESCRIPTION OF THE INVENTION

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

With reference to FIGS. 1-12, a cigar cutter 10 is described in accordance with an embodiment of the invention. The cutter 10 is described herein as a cigar cutter but embodiments of the invention are not so limited. For example, the cutter 10 may be employed and/or configured for cutting various other objects, such as cigarettes, cigarillos, little cigars, and other tobacco and non-tobacco products.

Figure 1:
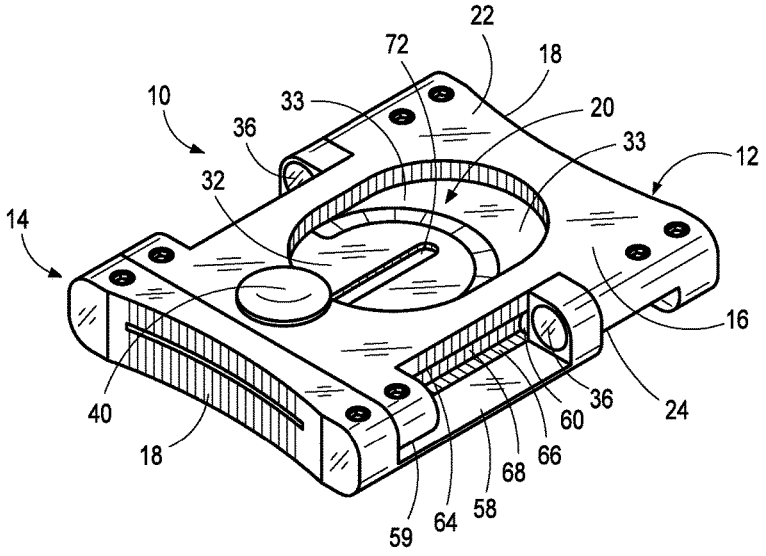
FIG. 1 is a perspective view of a cigar cutter is a closed state depicted in accordance with an embodiment of the invention.
Figure 2:
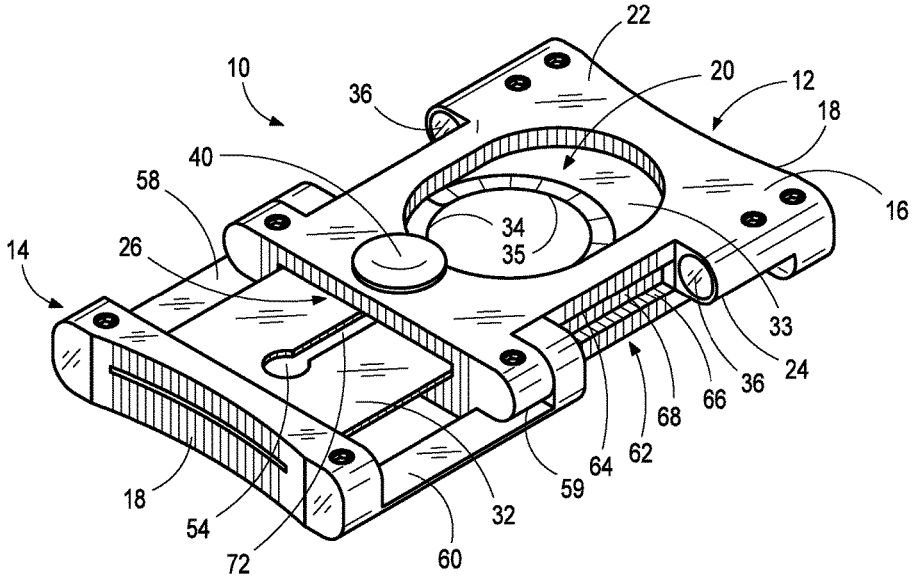
FIG. 2 is a perspective view of the cigar cutter of FIG. 1 in an open state depicted in accordance with an embodiment of the invention.
Figure 3:
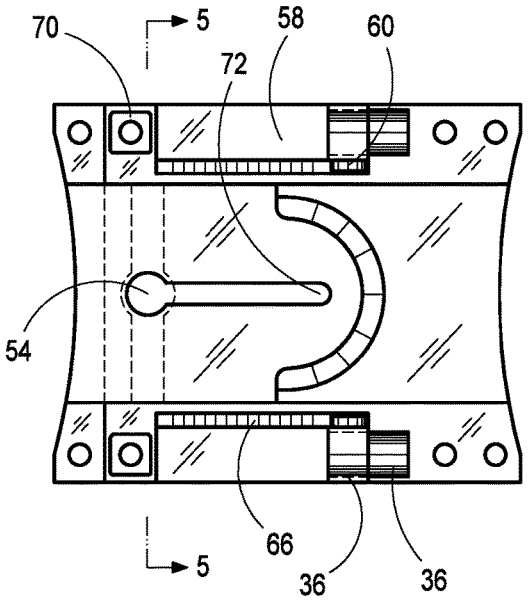
FIG. 3 is an internal view of the cigar cutter of FIG. 1 depicted with a top cover removed to shown an internal magnet in accordance with an embodiment of the invention.
Figure 4:
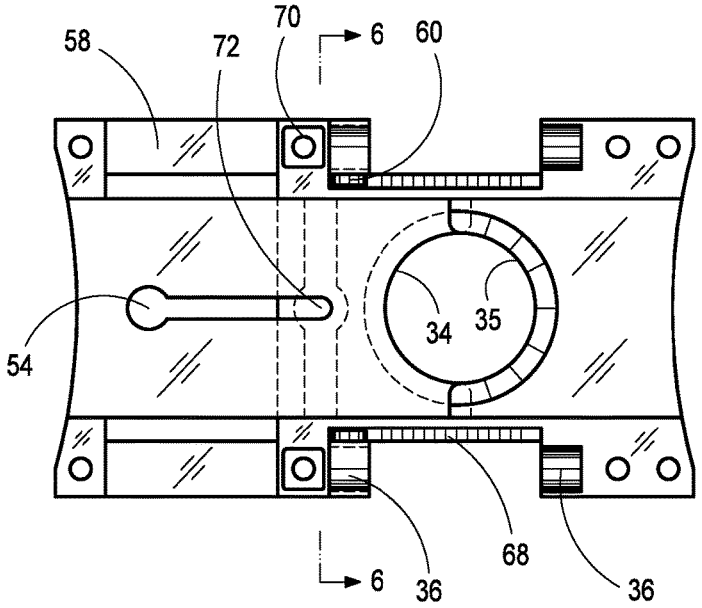
FIG. 4 is an internal view of the cigar cutter of FIG. 2 depicted with a top cover removed to show the the internal magnet in accordance with an embodiment of the invention.

The cutter 10 includes a body 12, a first blade assembly 14 that is translationally moveable between a collapsed position, and a second fixed blade assembly 16 shown in FIG. 1 and an extended position shown in FIG. 2. In the collapsed position, the body 12 and a handle portions at each end 18 of the blade assemblies 14, 16 form a rectangular cuboid shape with an elongated aperture 20 extending coaxially therethrough. The cutter 10 can take other overall forms that include the aperture 20 extending therethrough, e.g. non-cuboid forms.

The body 12 comprises a front plate 22 and a back plate 24 that when coupled together form a slot 26 extending through a central portion of the body 12 across the width of the body 12, e.g. along a length of the body, and perpendicular to the central axis of the aperture 20. The front and back plates 22, 24 also form a spring slot 28 in which a flat spring 30 is disposed as described more fully below.

Figure 5:
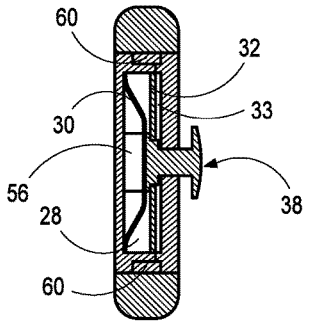
FIG. 5 is a vertical cross-sectional view of the cigar cutter taken along line 5-5 of FIG. 3, showing the trigger in the returned position depicted in accordance with an embodiment of the invention.
Figure 6:
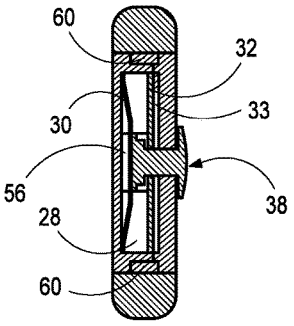
FIG. 6 is a vertical cross-sectional view of the cigar cutter taken along line 6-6 of FIG. 4, showing the trigger in the depressed position depicted in accordance with an embodiment of the invention.
Figure 7:
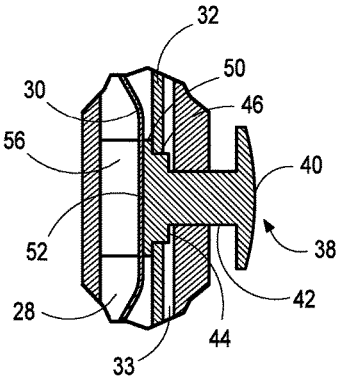
FIG. 7 is an enlarged vertical cross-sectional detail view of the cigar cutter taken from FIG. 5 depicted in accordance with an embodiment of the invention.
Figure 8:
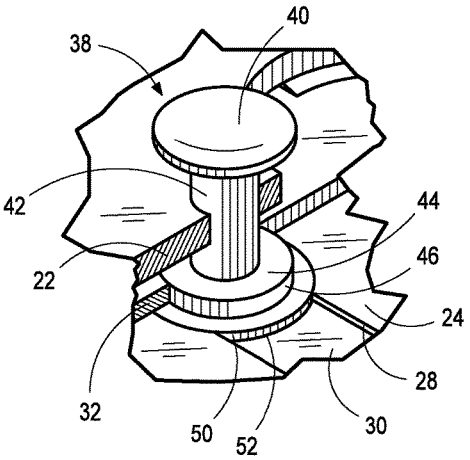
FIG. 8 is an enlarged partial perspective cut-away detail of FIG. 1, illustrating the trigger components more clearly in relation to the internal workings depicted in accordance with an embodiment of the invention.
Figure 9:
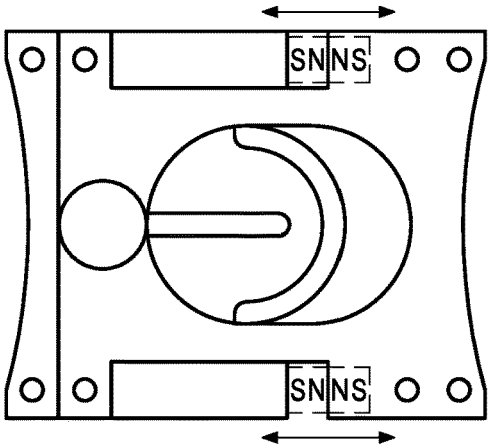
FIG. 9 is a top orthogonal view of the cigar cutter illustrating one of the many combinations the magnet fields could be oriented to achieve repulse-thrust depicted in accordance with an embodiment of the invention.
Figure 10:
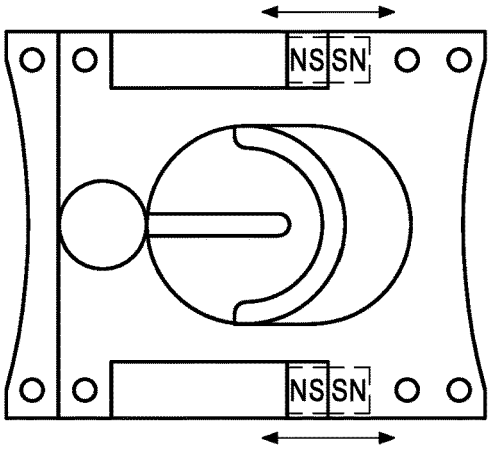
FIG. 10 is a top orthogonal view of the cigar cutter illustrating one of the many combinations the magnet fields could be oriented to achieve repulse-thrust depicted in accordance with an embodiment of the invention.
Figure 11:
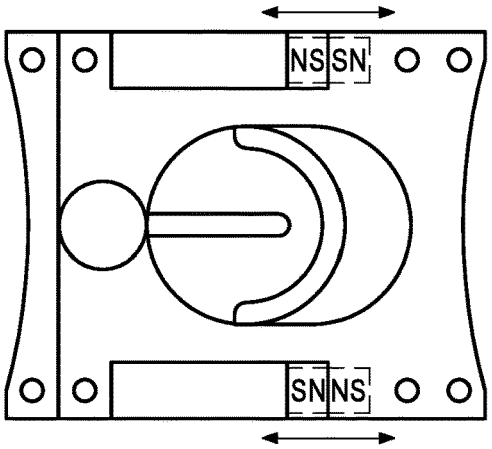
FIG. 11 is a top orthogonal view of the cigar cutter illustrating one of the many combinations the magnet fields could be oriented to achieve repulse-thrust depicted in accordance with an embodiment of the invention.
Figure 12:
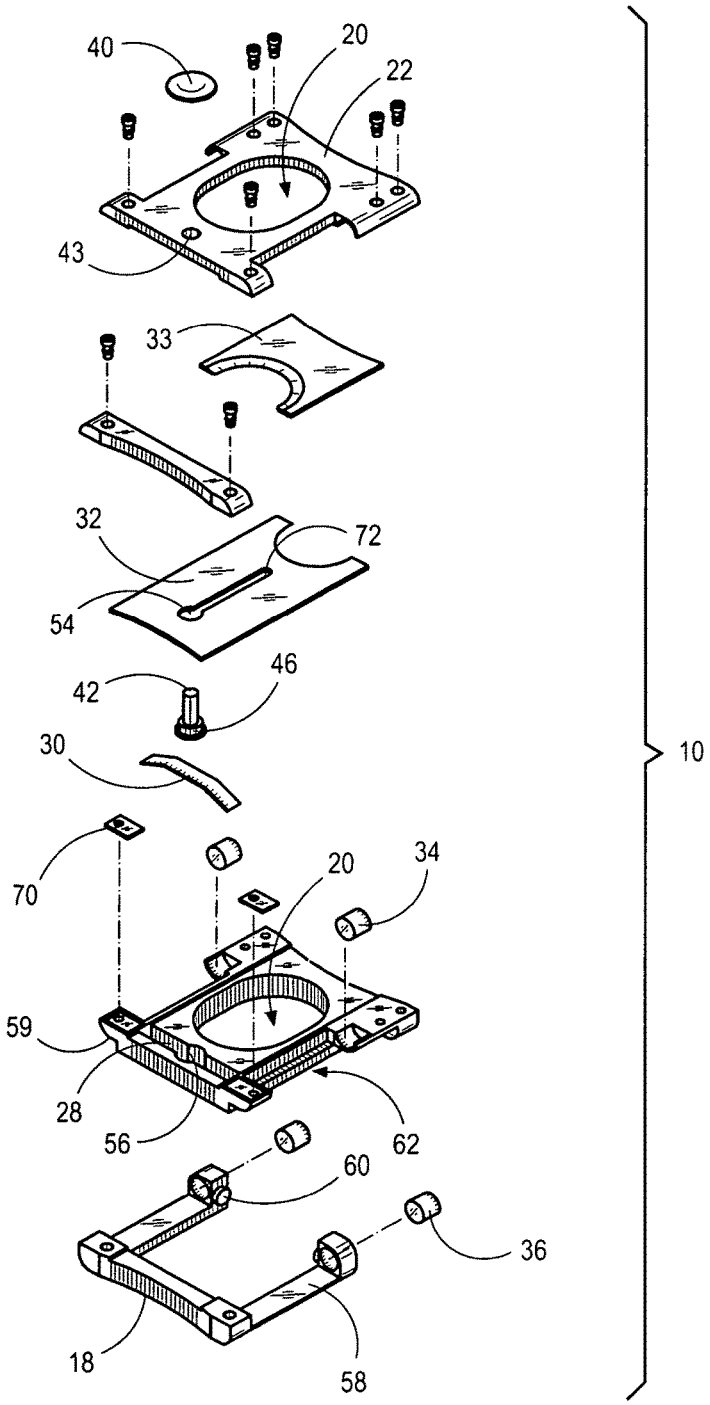
FIG. 12 is an exploded view of the cigar cutter of FIG. 1.

As best shown in FIG. 5, the blade assemblies 14, 16 each include a blade 32, 33 respectively, with the handle portions 18 coupled to first and second ends thereof. The handle portions 18 are coupled to the blades 32, 33, such as by fasteners, adhesives, welding or the like, and preferably have a form that compliments or completes the overall cuboid shape of the body 12 when in the collapsed position. However, the handle portions 18 may take any desired form. The handle portions 18 may define a maximum extent of travel of the blade assembly 14, 16 into/toward the body 12 and preferably provide a distal surface upon which a user can apply an inwardly directed force for moving the blade assemblies 14, 16 toward one another.

An opposite second end of the blades 32, 33 forms a sharp cutting edge 34, 35. The cutting edges 34, 35 are depicted in FIGS. 1-12 as being curved to generally follow the circumference of the aperture 20; the radius of the curvature is approximately the same as or just larger than that of the aperture 20. In another embodiment, the cutting edges 34, 35 are straight, serrated, faceted, or otherwise arranged. For example, the cutting edges may be linear and aligned at an angle relative to the direction of travel of the blades 32, 33. Or the cutting edges might be bifurcated into two linear facets arranged at angles to one another to provide a V-shaped cutting edge, among a variety of other configurations.

The blade assemblies 14, 16 are oppositely oriented to direct their cutting edges 34, 35 toward one another. The blades 32, 33 are offset in the axial direction of the aperture 20 so as to enable the blades 32, 32 to move toward and/or slide past one another in an overlapping relationship.

A magnet 36 is disposed within the body 12 and on the blade assembly 14. The magnets 36 are magnetically oriented on the body 12 and blade assembly 14 so their poles respectively provide a magnetic thrust for bias movement of the blade assembly 14 toward an extended position when a central trigger 38 is depressed.

A trigger 38 locks and unlocks the cutter 10 and is comprised of a concentric cylinders stacked in a central axis with various parts of importance 40, 42, 44, 46, 48, 50, 52. The trigger 38 is retained by the a base edge 50 captured inside a circular slot 56, When the cutter 10 is in the locked position, the base edge 50 aligns with and is flush with a blade hole 54 and is retained with bias force of the flat spring 30 from the underside of a base bottom 52 transferred through a base top 48 that terminates into the inside face of front plate 22.

To unlock the cutter 10, a cap 40 is depressed to move the trigger 38 deeper into the circular slot 56. Consequently, the flat spring 30 recesses into the spring slot 28 simultaneously moving the lock out of alignment with a blade hole 54 to allow bias translational movement of the first blade assembly 14 outward. Magnets 36 are positioned on the first blade assembly 14 and are affixed on proximal end of a rail 58 to align with magnets 36 affixed on fixed blade assembly 16. The magnets 36 are oriented so their magnetic poles face each other respectfully to create a repulse-thrust effectively driving the cutter 10 open. Alignment and non-deviation of repulse-thrust is achieved by rails 58 mating with a notch 59 on body 12 and a circular shaped nub 60 extending perpendicularly into a recessed side slot 62 on body 12. The side slot 62 is a rectangular void defined by a side slot top 64, a side slot bottom 66 and a side slot face 68 that terminate short on each end of the body 12. The nubs 60 and side slot 62 ensure perfect alignment of magnets 36 on the first blade assembly 14 and body 12 to harness maximum energy from the initial repulse-thrust when depressing trigger 38 to unlock first blade assembly 14.

When the trigger 38 is depressed and held the cutter 10 is deployed. Magnets 36 on the first blade assembly 14 are magnetically attracted to a metal inserts 70 embedded within the body 12 to semi-lock the first blade assembly 14 in the fully open position. The trigger 38 is then released. The spring 30 transfers bias force into the trigger 38. This upward force effectively engages the break 44 to frictionally resists along the entire underside span of the blade slot 72 located on the first blade 32. The break 44 prevents the first blade assembly 14 from accidentally moving whereby preventing the cutter 10 from falling closed when held in the hand and/or operating the cut.

Cutting the cigar tip is preformed and the cutter 10 fully closes while simultaneously the flat spring 30 returns the trigger 38 to its original position to lock the first and second blades 32, 33 together through the union of the lock 46 and blade hole 54.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

Having thus described the invention, what is claimed as new and described to be secured by the Letters Patent is as follows:

1. A cigar cutting device comprising: a substantially planar body forming an aperture and a slot extending through the body, the aperture extending in a direction substantially perpendicular to the planar body, and the slot extending in a direction substantially parallel to the planar body and intersecting the aperture, the aperture having dimensions sufficient to receive an end of a cigar at least partially therein; a first blade assembly including a first cutting blade disposed in the slot from a first edge of the body and translationally moveable within the slot to at least partially obstruct the aperture; a second blade assembly including a second cutting blade disposed in the slot from a second edge of the body and fixed within the slot to at least partially obstruct the aperture, the second edge being opposite the first edge; an at least one first magnet disposed on the planar body; and an at least one second magnet disposed on the first blade assembly, the first and second magnets oriented to cause bias translational movement of first cutting blade, the first and second magnets oriented to cause repulsion of the first blade assemble away from the planar body.

2. The cigar cutter device as claimed in claim 1, wherein the repulsion of the first and second magnets respectfully to one another causes their magnetic poles to bias translational movement of the first cutting blade edge.

3. The cigar cutter device as claimed in claim 2, wherein the first cutting blade has a cutout groove.

4. The cigar cutter device as claimed in claim 3, further comprising: a trigger, wherein the trigger is disposed in the cutout groove to release and retain the first cutting blade edge closed within the planar body.

5. The cigar cutter device as claimed in claim 4, further comprising: a spring, wherein the spring engages with the trigger and is disposed within the body.

6. The cigar cutter device as claimed in claim 5, wherein the body includes a channel formed in an interior wall thereof, and wherein the spring and trigger are disposed in the channel.

7. A cigar cutting device comprising: a substantially planar body forming an aperture and a slot extending through the body, the aperture extending in a direction substantially perpendicular to the planar body, and the slot extending in a direction substantially parallel to the planar body and wherein the spring engages with the trigger and is disposed within the body the aperture, the aperture having dimensions sufficient to receive an end of a cigar at least partially therein; a first blade assembly including a first cutting blade disposed in the slot from a first edge of the body and translationally moveable within the slot to at least partially obstruct the aperture; a second blade assembly including a second cutting blade disposed in the slot from a second edge of the body and fixed within the slot to at least partially obstruct the aperture, the second edge being opposite the first edge; an at least one first magnet disposed on the first cutting blade and an at least one second magnet disposed on the second blade assembly, and the first and second magnets oriented to cause bias translational movement of the first cutting blade, the first and second magnets oriented to cause repulsion of the first blade assemble away from the planar body.

8. The cigar cutter device as claimed in claim 7, wherein the repulsion of the first and second magnets respectfully to one another causes their magnetic poles to bias translational movement of the first cutting blade edge.

9. The cigar cutter device as claimed in claim 8, wherein the first cutting blade has a cutout groove.

10. The cigar cutter device as claimed in claim 8, further comprising: a trigger, wherein the trigger is disposed in the cutout groove to release and retain the first cutting blade edge closed within the planar body.

11. The cigar cutter device as claimed in claim 10, further comprising: a spring, wherein the spring engages with the trigger and is disposed within the body.

12. The cigar cutter device as claimed in claim 11, wherein the body includes a channel formed in an interior wall thereof, and wherein the spring and trigger are disposed in the channel.

13. A cigar cutting device comprising: a substantially planar body forming an aperture and a slot extending through the body, the aperture extending in a direction substantially perpendicular to the planar body, and the slot extending in a direction substantially parallel to the planar body and intersecting the aperture, the aperture having dimensions sufficient to receive an end of a cigar at least partially therein; a first blade assembly including a first cutting blade disposed in the slot from a first edge of the body and translationally moveable within the slot to at least partially obstruct the aperture; a second cutting blade disposed in the slot from a second edge of the body and translationally moveable within the slot to at least partially obstruct the aperture, the second edge being opposite the first edge, and the second cutting blade translationally moveable to at least partially overlap the first cutting blade within the aperture; and at least one first magnet disposed on the first cutting blade; and at least one second magnet disposed on the second blade assembly, the first and second magnets oriented to cause bias translational movement of the first and second cutting blades, the first and second magnets oriented to cause repulsion of the first blade assemble away from the planar body.

14. The cigar cutter device as claimed in claim 13, wherein the repulsion of the first and second magnets respectfully to one another causes their magnetic poles to bias translational movement of the first cutting blade edge.

15. The cigar cutter device as claimed in claim 14, wherein the first and second cutting blades have a cutout groove.

16. The cigar cutter device as claimed in claim 15, further comprising: a trigger, wherein the trigger is disposed in the cutout groove to release and retain the first cutting blade edge closed within the planar body.

17. The cigar cutter device as claimed in claim 16, further comprising: a spring, wherein the spring engages with the trigger and is disposed within the body.

18. The cigar cutter device as claimed in claim 17, wherein the body includes a channel formed in an interior wall thereof, and wherein the spring and trigger are disposed in the channel.

* * * * *